US012285092B2

(12) United States Patent
Haack

(10) Patent No.: US 12,285,092 B2
(45) Date of Patent: Apr. 29, 2025

(54) MOBILE WHEELED CASE

(71) Applicant: Scott Graham Haack, Chardon, OH (US)

(72) Inventor: Scott Graham Haack, Chardon, OH (US)

( * ) Notice: Subject to any disclaimer, the term of this patent is extended or adjusted under 35 U.S.C. 154(b) by 132 days.

(21) Appl. No.: 18/184,516

(22) Filed: Mar. 15, 2023

(65) Prior Publication Data

US 2023/0292895 A1 Sep. 21, 2023

Related U.S. Application Data

(60) Provisional application No. 63/320,112, filed on Mar. 15, 2022.

(51) Int. Cl.
*A45C 5/14* (2006.01)
*A45C 13/00* (2006.01)
*A45C 13/26* (2006.01)

(52) U.S. Cl.
CPC ..... *A45C 5/141* (2013.01); *A45C 13/001* (2013.01); *A45C 13/262* (2013.01)

(58) Field of Classification Search
CPC ..... A45C 5/141; A45C 13/001; A45C 13/262
USPC ..... 190/18 A
See application file for complete search history.

(56) References Cited

U.S. PATENT DOCUMENTS 5,343,988 A * 9/1994 Bartsch ..... A45C 5/145 280/37
5,464,081 A * 11/1995 Zwanzig ..... A45C 13/262 16/113.1
5,873,439 A * 2/1999 Liang ..... A45C 5/14 280/43.1
6,148,971 A * 11/2000 Kho ..... A45C 5/143 190/115
6,865,777 B2 * 3/2005 Comstock ..... A45C 13/262 16/446
11,297,916 B2 * 4/2022 Shalgi ..... A45C 5/06
2006/0219745 A1 * 10/2006 Riley ..... A47G 23/0225 224/400
2014/0110202 A1 * 4/2014 Vesterby ..... A45C 13/001 190/103
2016/0206069 A1 * 7/2016 Tong ..... A45C 5/02
2017/0144684 A1 * 5/2017 Cho ..... A45C 5/14
(Continued)

OTHER PUBLICATIONS

Briggs & Riley, Luggage, retrieved from Internet, retrieved on Mar. 15, 2023, <URL: https://www.briggs-riley.com/collections/luggage>.

(Continued)

*Primary Examiner* — Sue A Weaver

(57) ABSTRACT

The present invention is a wheeled case with enhanced mobility on all surfaces as seen in the mobile wheeled case has a main body, a of side wheels, a handle, an extending wheel system, and a cup holder. The main body holds various luggage items. The extending wheel system allows the present invention to stand or roll with the main body positioned in various ways. The main body has a of attachment rails, a main compartment, a side compartment, and connecting rails. The side wheels have a side wheel pivot that allows the wheels to tilt inwards. The handle has a handle hinge and a handle button. The extending wheel system has an extending wheel, an extending wheel hinge, an extending wheel lock, and an extending wheel rotator.

20 Claims, 6 Drawing Sheets

(56) References Cited

U.S. PATENT DOCUMENTS

| | | | | |
|---|---|---|---|---|
| 2017/0354218 | A1* | 12/2017 | Kim | A45C 5/14 |
| 2024/0049852 | A1* | 2/2024 | Verma | A45C 13/262 |

OTHER PUBLICATIONS

Solo, Luggage, retrieved from Internet, retrieved on Mar. 15, 2023, <URL: https://solo-ny.com/collections/luggage>.
Tumi, Luggage, retrieved from Internet, retrieved on Mar. 15, 2023, <URL: https://www.tumi.com/c/luggage/>.
Samsonite, Luggage, retrieved from Internet, retrieved on Mar. 15, 2023, <URL: https://shop.samsonite.com/luggage/>.
Solgaard, Suitcases, retrieved from Internet, retrieved on Mar. 15, 2023, <URL: https://shop.samsonite.com/luggage/>.
Pelican, Cases, retrieved from Internet, retrieved on Mar. 15, 2023, <URL: https://www.pelican.com/us/en/products/cases>.
Rimowa, Suitcases, retrieved from Internet, retrieved on Mar. 15, 2023, <URL: https://www.rimowa.com/us/en/all-luggage/>.
Monos, Luggage, retrieved from Internet, retrieved on Mar. 15, 2023, <URL: https://monos.com/collections/luggage>.

* cited by examiner

MOBILE WHEELED CASE

FIELD OF THE INVENTION

The present invention relates to a wheeled case having improved mobility on even and uneven surfaces and more particularly, relates to luggage with positional negative camber wheels and an extendable arm with a swivel wheel to reduce the effects of gravity and unwanted stress on the body while transporting a wheeled case.

BACKGROUND OF THE INVENTION

The problem that exists with current luggage or wheeled cases that contain four-eight spinners, or two rollers is that it is either good on even surfaces and not good on uneven surfaces or it causes strain to the body due to the weight of the unit. There is not a case available that is good on even and uneven surfaces, rough terrain, spins and reduces stress to the body when traveling. Spinner wheels are good on flat surfaces but are less functional on rugged or uneven surfaces. Since the wheels spin around they can easily get caught in bumps or cracks, and anything not super flat. It is very difficult to roll a spinner luggage on snow or upright on cobblestones, rocks, or brick paths. When encountering such uneven terrains, users will have to tilt their luggage and pull it like roller luggage. This will then cause undue strain on the two wheels touching the ground and will cause some damage. A slight incline can also cause the spinner to break off. With that said, spinners are great for reducing stress and strain to the user while traveling and having the ability to spin upright on a dime. A spinner luggage stands upright on four-eight wheels, requiring less effort in rolling the luggage around. A roller luggage is more dependable on rough terrain and the wheels are much more durable because they do not allow for as many movements as the spinner. However, because of its inflexible wheels, rollers only move in the direction the user pulls them, and the user cannot transport it upright or spin it around like the luggage with spinner wheels. Since the weight of the roller luggage is supported by one hand, pressure is put on the joints, shoulders, and wrists as the luggage is pulled behind the user. With the implement of larger wheels that can be positioned outward with a negative camber affect handling is improved by keeping the contact points of the wheels evenly loaded for a smooth and responsive transport. In addition, the central back portion of the luggage contains an extendable arm or lever to provide additional support by eliminating the effects of gravity on the wrists, back and shoulders during travel. With these three points touching the ground and the luggage in an angled position the luggage can be pushed or pulled without the weight of the luggage acting on the body. Also, since the extendable arm has wheels that swivel the unit can spin on its axis and can be transported on even, uneven, and rugged surfaces.

DETAIL DESCRIPTIONS OF THE INVENTION

All illustrations of the drawings are for the purpose of describing selected versions of the present invention and are not intended to limit the scope of the present invention.

Figure 4:
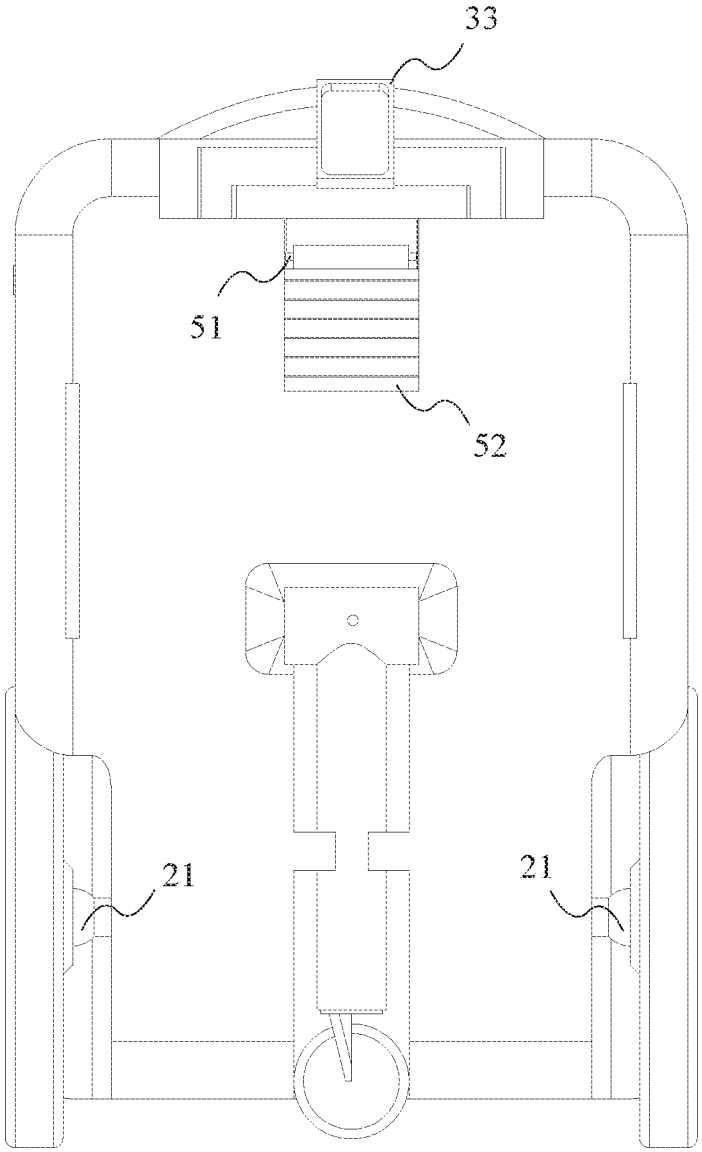
FIG. 4 is a rear view of the present invention.
Figure 5:
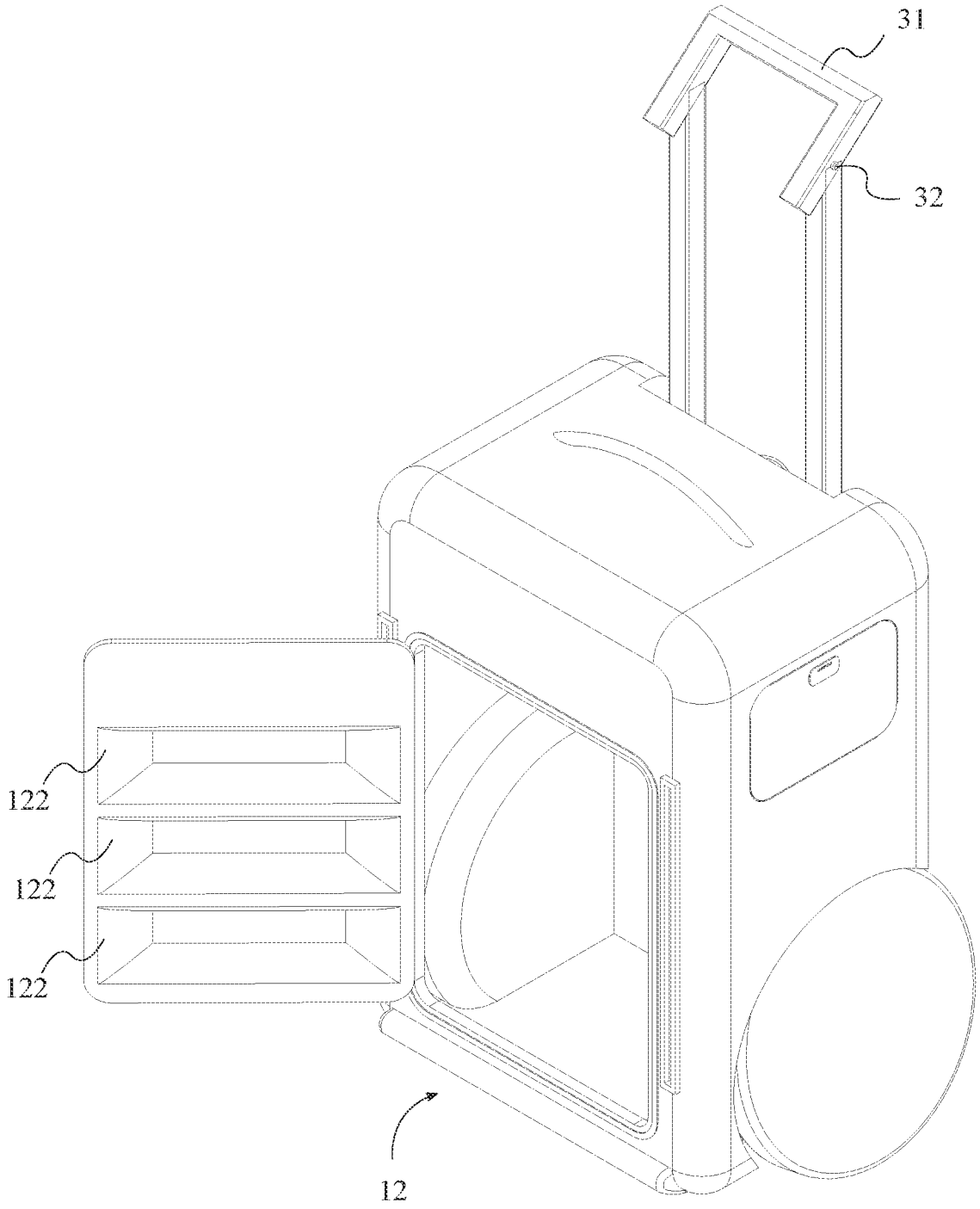
FIG. 5 is a top front perspective view of the present invention with the handle and extending wheel in an extended position.

The present invention is a wheeled case with enhanced mobility on all surfaces as seen in FIG. 1-6. The mobile wheeled case comprises a main body 1, a plurality of side wheels 2, a handle 3, an extending wheel system 4, and a cup holder 5. The main body 1 is holds various luggage items. The extending wheel system 4 allows the mobile wheeled case to be positioned in various orientations while standing still or being rolled. The main body 1 comprises a plurality of attachment rails 11, a main compartment 12, a side compartment 13, and a plurality of plurality of connecting rails 14. The plurality of attachment rails 11 is rectangular attachment lines that allow for external devices to interlock along the main body 1. The plurality of plurality of connecting rails 14 is rectangular attachment lines that can interlock to the plurality of attachment rails 11 of a second mobile wheeled case, connecting multiple mobile wheeled cases together. The plurality of side wheels 2 comprises a side wheel pivot 21. The side wheel pivot 21 provides different tilting orientations of the plurality of side wheels 2 as shown in FIG. 5. The handle 3 comprises a handle hinge 31 and a handle button 32. The extending wheel system 4 comprises an extending wheel 41, an extending wheel hinge 42, an extending wheel lock 43, and an extending swivel arm 44. The extending wheel hinge 42 allows the extending wheel system 4 to swing out from the main body 1. The extending swivel arm 44 is a connection that allows for rotation about the extending wheel system 4 central axis. The cup holder 5 comprises a cup holder hinge 51. The plurality of side wheels 2 is positioned along the left and right side of the bottom of the main body 1. As a result, the main body 1 has a wheel on the left and right side. The handle 3 is integrated along the top side of the main body 1. Consequently, the handle 3 is easily accessible from the top side of the main body 1. The extending wheel system 4 is integrated centrally along the rear side of the main body 1. Accordingly, the extending wheel system 4 can provide a third rolling support point for the main body 1. The cup holder 5 is integrated on the top side of the main body 1. Thus, the cup holder 5 is easily accessible from the top side of the main body 1. The cup holder 5 is positioned offset the handle 3. So, the cup holder 5 does not interfere with the handle 3 alongside the top of the main body 1.

Figure 1:
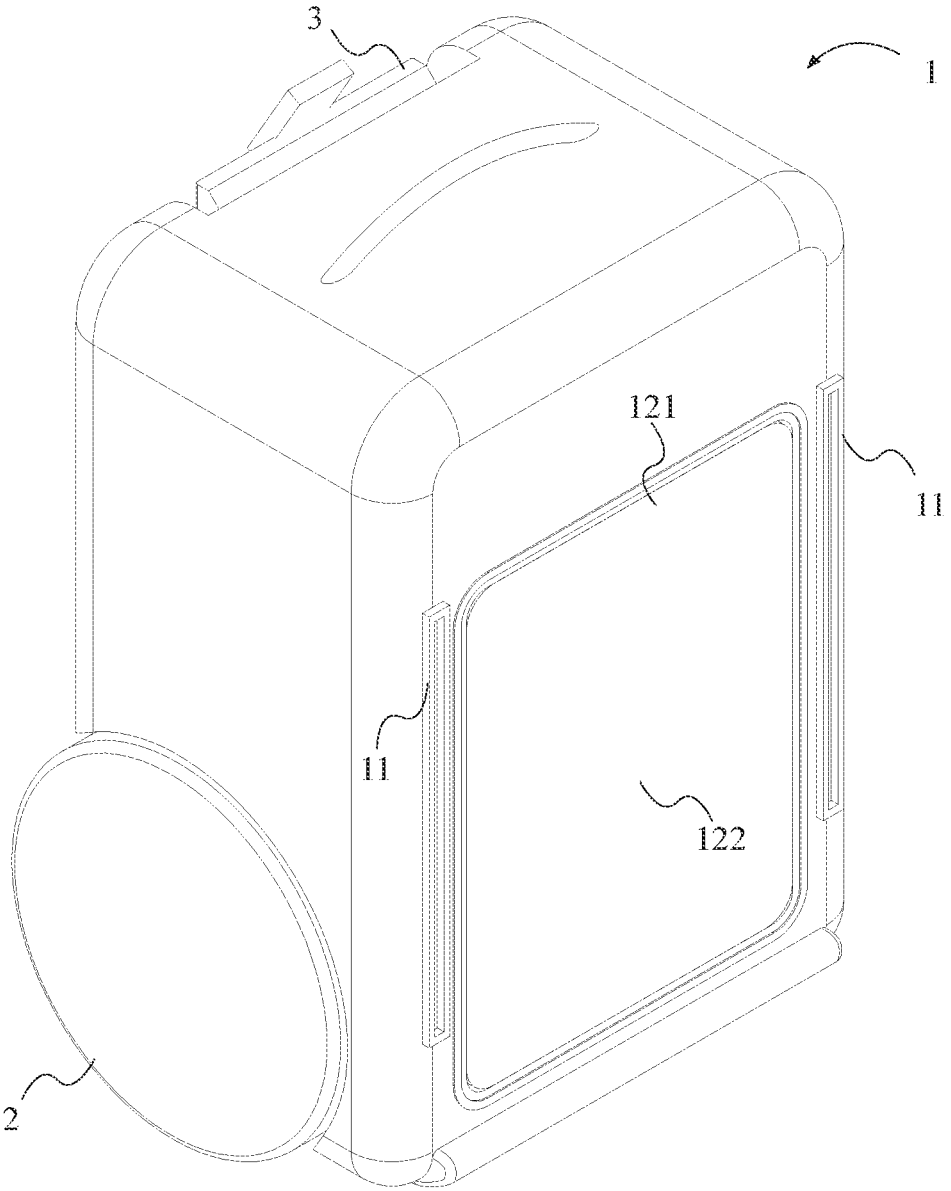
FIG. 1 is a top front perspective view of the present invention.

In reference to FIG. 1, the main body 1 of the mobile wheeled case is a rectangular hollow shape. The rectangular hollow shape allows the present invention to receive various luggage items. The main body 1 has curved edges. The plurality of attachment rails 11 is integrated along the front side of the main body 1. The plurality of attachment rails 11 is a convex rail designed to connect to concave rails. The plurality of attachment rails 11 receives an external accessory. As a result, the plurality of attachment rails 11 secures any external accessory such as a baby carriage, backpack or car seat. The plurality of attachment rails 11 receives a plurality of plurality of connecting rails 14. Consequently, the plurality of attachment rails 11 and the plurality of plurality of connecting rails 14 act as tongue in groove connections to secure to each other. This way the user can easily obtain items, put items away in an external backpack without having to disrupt the main luggage. Plus, it allows for easy transport stress free without having to deal with the present invention being top heavy due to the weight of the items stacked on top of the present invention. This top-heavy weight can affect the way the luggage rolls. The main compartment 12 is integrated into the center of the main body 1. Accordingly, the main compartment 12 stores various items such as clothing, shoes, and other travel apparel. The side compartment 13 is integrated along the side of the main body 1. Thus, the side compartment 13 provides access to the items within the main compartment 12 without having to open the entire main compartment 12. The plurality of plurality of connecting rails 14 is integrated along the front side of the main body 1. So, the plurality of plurality of connecting rails 14 provides an option to connect the present invention in series allowing each main body 1 to roll and move together. The plurality of plurality of connecting rails 14 is positioned offset the extending wheel system 4. As a result, the plurality of plurality of connecting rails 14 does not interfere with the extending wheel system 4. The main compartment 12 comprises a zipper 121 and a main compartment flap 122. The main compartment flap 122 is a door that provides a large opening to the main compartment 12. The side compartment 13 comprises a latch 131. The latch 131 securing the side compartment 13 closed to the main body 1.

Further, the main body 1 is a polycarbonate material. Thus, the main body 1 has a rigid structure to provides protection to the items stored within the main compartment 12. As seen in FIG. 5, the main compartment flap 122 is positioned centrally along the front of the main body 1. So, the main compartment flap 122 provides a large and easy access point to the items stored within the main compartment 12. The main compartment flap 122 is a flexible material. As a result, the main compartment flap 122 can expand outwards to allow more items to be stored within the main compartment 12. The main compartment flap 122 opens to reveal the main compartment 12. Consequently, the main compartment flap 122 secures the items within the main compartment 12 and opens to reveal the items within the main compartment 12. The zipper 121 traverses around the main compartment flap 122. The zipper 121 secures the main compartment flap 122 shut when zipped closed. Accordingly, the zipper 121 creates a secure connection between the main body 1 and the main compartment flap 122 to keep the main compartment 12 closed as the present invention is in transport.

Furthermore, the main compartment flap 122 comprises a plurality of mesh pockets 1221 as seen in FIG. 5. The plurality of mesh pockets 1221 are designed to secure additional smaller objects within the main compartment 12 that need to be separated from the other objects. The main compartment flap 122 is positioned along the inner side of the main compartment flap 122. Thus, the plurality of mesh pockets 1221 is positioned within the main compartment 12 when the main compartment flap 122 is closed. The plurality of mesh pockets 1221 expands to receive various external items. So, the plurality of mesh pockets 1221 is flexible to hold items of various sizes.

Figure 2:
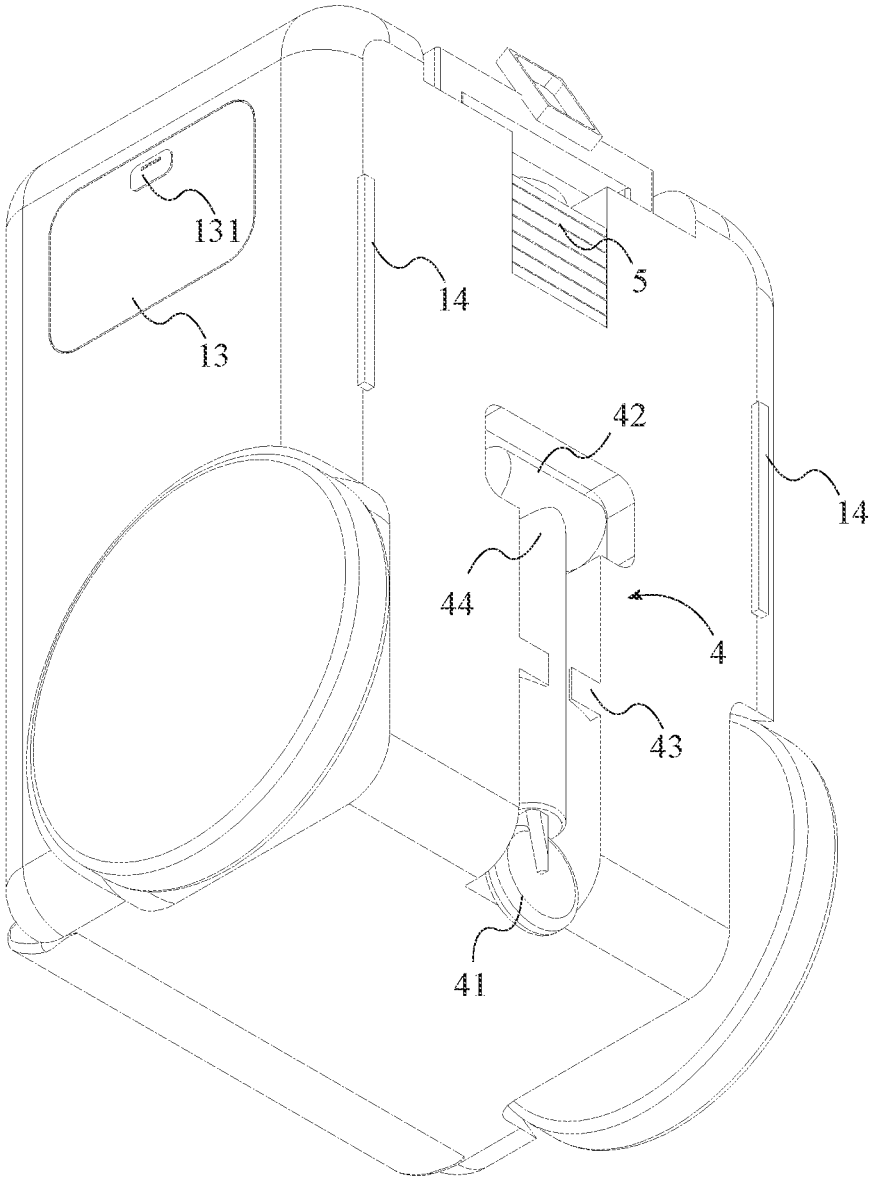
FIG. 2 is a rear bottom perspective view of the present invention.
Figure 3:
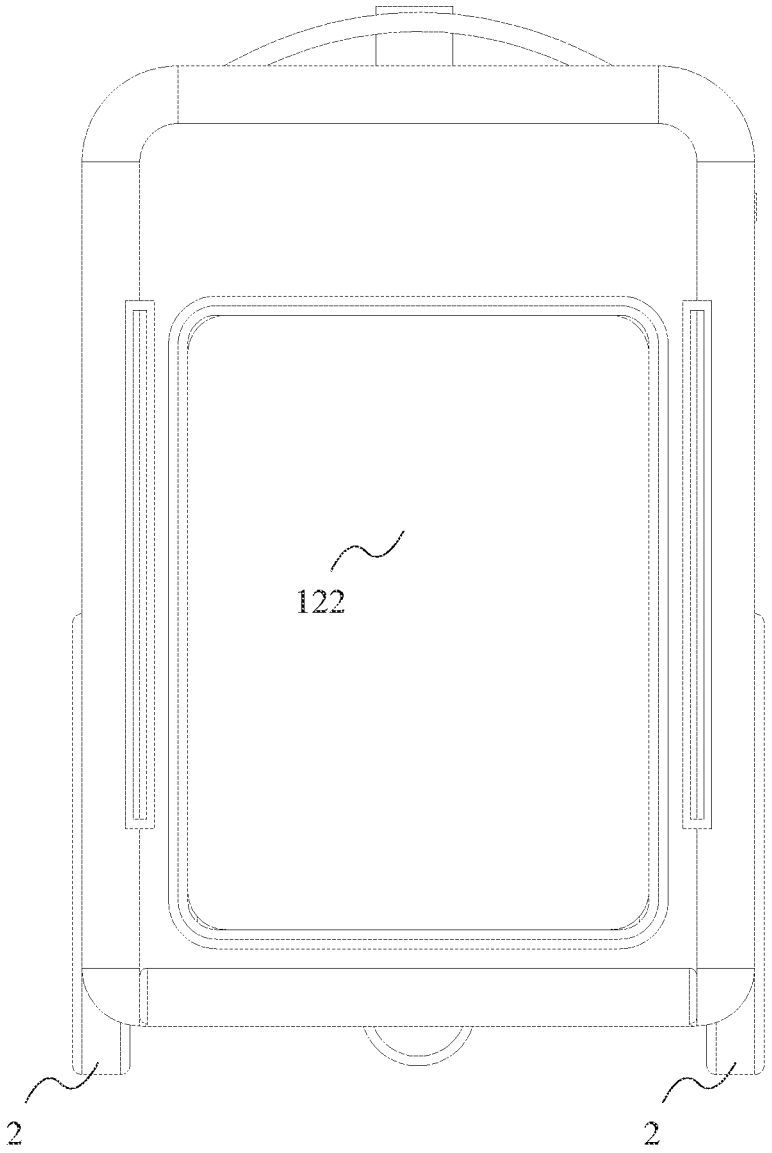
FIG. 3 is a front view of the present invention.

Further, the latch 131 secures the side compartment 13 closed to the main body 1 as seen in FIG. 2. As a result, the side compartment 13 opens and closes with a hinged motion as the latch 131 is unlocked. As the latch 131 is locked, the side compartment 13 stays securely locked and flush with the main body 1. The latch 131 pulls outwards to unlock the side compartment 13. Consequently, the latch 131 unlocks the side compartment 13 when pulled outwards, which allows the side compartment 13 to open freely. The latch 131 is a locking mechanism. Accordingly, the latch 131 utilizes a combination lock to lock and unlock the side compartment 13 to ensure only authorized access to the main compartment 12 via the side compartment 13.

In reference to FIG. 4, the present invention rolls in various directions along the ground. the plurality of side wheels 2 rotates around the plurality of side wheels 2 central axis. Thus, the plurality of side wheels 2 allows for the main body 1 to roll along the ground when pushed or pulled. The side wheel pivot 21 allows the plurality of side wheels 2 to tilt in and out. So, the plurality of side wheels 2 is pulled outwards along the bottom of the plurality of wheels or is pushed inwards along the top of the plurality of wheels to create a tilted position for the plurality of side wheels 2. This provides a camber position for the plurality of side wheels 2 to provide enhanced mobility for the present invention.

Figure 6:
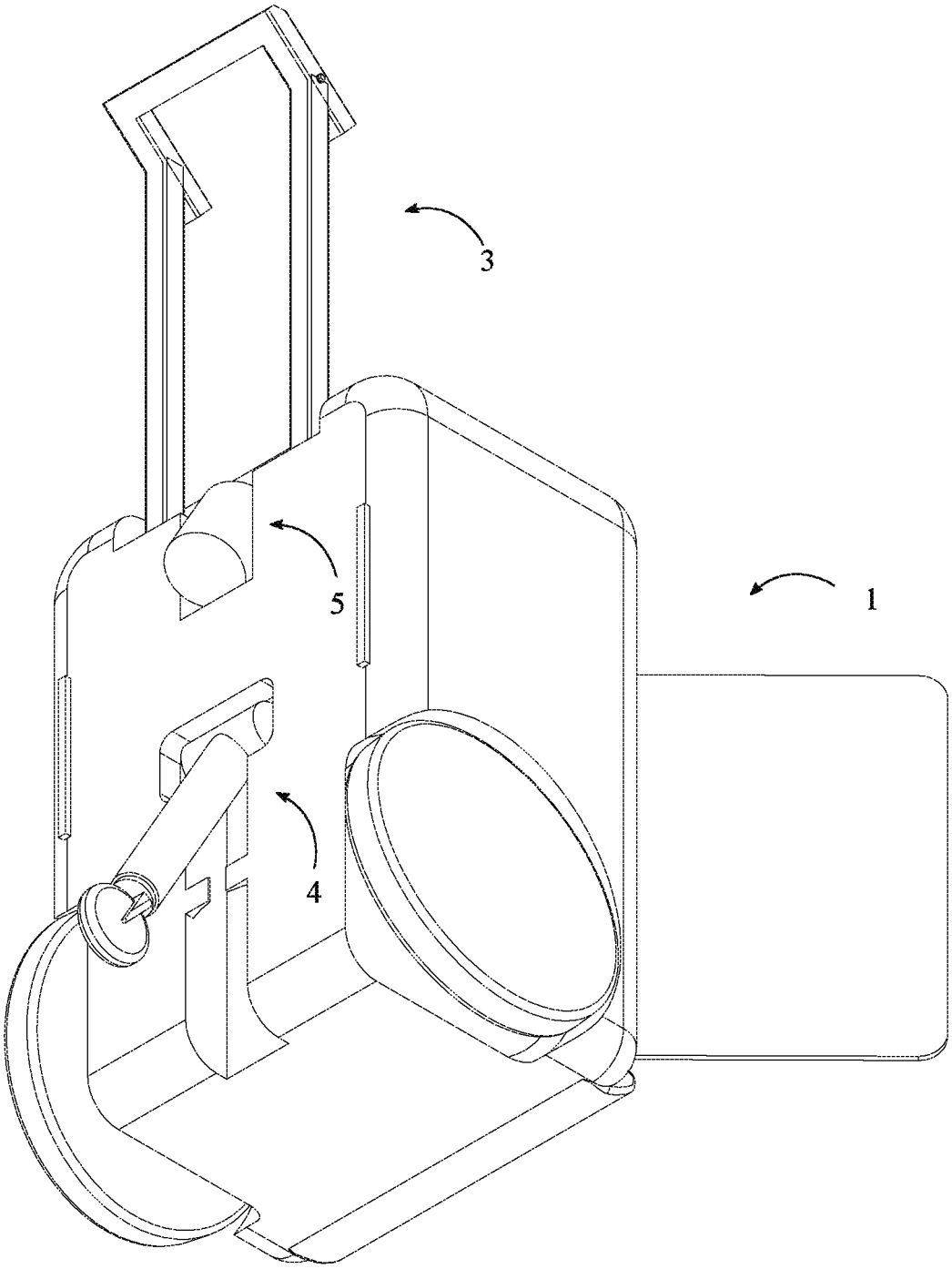
FIG. 6 is a bottom rear perspective view of the present invention with the handle and extending wheel in an extended position.

In reference to FIG. 6, the present invention is primarily pushed or pulled with the handle 3. The handle 3 extends out from the main body 1. As a result, the handle 3 provides an ergonomically comfortable way to grab the present invention and pull or push the present invention. The handle 3 collapses into the main body 1. Consequently, when the handle 3 is not in use it can be stored within the main body 1 to create a more compact profile of the present invention. The handle hinge 31 folds the top of the handle 3 with respect to the rest of the handle 3. Accordingly, as the present invention is tilted to another orientation the handle hinge 31 allows the handle 3 to support proper hand placement and biomechanics. The handle button 32 is integrated along the handle hinge 31. Thus, the handle button 32 is easily accessible while the handle 3 is extended from the main body 1. The handle button 32 mechanically locks and unlocks the handle hinge 31. So, the handle button 32 controls the orientation of the handle 3 to support various orientations of the present invention.

Further, the handle 3 further comprises a phone case as seen in FIG. 5. The phone case 33 is a grip designed to hold a rectangular item. The phone case 33 secures an external mobile device. As a result, the phone case 33 provides the comfortable viewing angle of the external mobile device as the present invention is being pushed. The phone case 33 secures to the top of the handle 3. Consequently, the external mobile device is positioned higher up by the phone case 33.

In reference to FIG. 6, the present invention moves around with various standing orientations. The extending wheel 4 rotates on the extending wheel system 4. Accordingly, the extending wheel system 4 provides a third contact between the present invention and the ground releasing joint pressure when being pulled or pushed. The extending wheel system 4 rotates along the ground allowing the present invention to roll along the ground. The extending wheel system 4 contacts the ground below the present invention. Thus, the extending wheel system 4 creates a tripod stand for the present invention to stay in a tilted orientation. The extending wheel hinge 42 secures the extending wheel system 4 to the main body 1. So, the extending wheel hinge 42 creates a pivot point at the top of the extending wheel system 4, securing the top of the extending wheel system 4 to the main body 1 and allowing the rest of the extending wheel system 4 to swing outwards. The extending wheel hinge 42 swings the extending wheel system 4 outwards from the main body 1. In addition, the present invention can also flatten out with the extending wheel system 4 to allow for an ottoman experience while at the airport allowing the user to spread out.

Further, the extending wheel lock 43 secures the extending wheel 4 into the main body 1. As a result, the extending wheel 4 will not accidentally swing out from the main body 1 when the main body 1 is tilted. The extending wheel lock 43 releases the extending wheel system 4 from the main body 1. Consequently, the extending wheel lock 43 allows the extending wheel system 4 to swing outwards from the main body 1 when the tripod position is desired. The extending swivel arm 44 allows the extending wheel 41 to rotate 360 degrees with respect to the extending wheel system 4 axis. Accordingly, the extending swivel arm 44 allows the extending wheel 4 to swivel while it rotates to allow the present invention to roll any direction along the ground.

Furthermore, the extending wheel lock 43 comprises a wheel lock button as seen in FIG. 5. Thus, the wheel lock button controls the extending wheel lock 43. The extending wheel lock 43 mechanically locks and unlocks the extending wheel system 4. This ensures the extending wheel lock 43 is not accidentally controlled.

In reference to FIG. 4, The cup holder 5 comprises a cup holder hinge 51 and a cup holder wall 52. The cup holder 5 is a cylindrical hollow component with an open top face that allows it to receive a cup or bottle. The cup holder 5 secures an external cup. The cup holder wall 52 slides up and down to hold the cup holder 5 in place. As a result, when the cup holder wall 52 is pulled up the cup holder 5 is secured in place and as the cup holder wall 52 is pulled down the cup holder 5 can tilt along with the main body 1. The cup holder hinge 51 allows the cup holder to rotate with respect to the main body 1. So, the cup holder hinge 51 is a rotating fastener attaching the cup holder 5 to the main body 1 providing the cup holder 5 with a degree of freedom for rotational motion. The cup holder 5 stays upright as the main body 1 is tilted. As a result, the cup holder 5 retains an upright position as the main body 1 is tilted due to the center of gravity positioned below the cup holder hinge 51.

Although the invention has been explained in relation to its preferred embodiment, it is to be understood that many other possible modifications and variations can be made without departing from the spirit and scope of the invention as hereinafter claimed.

What is claimed is:

1. A mobile wheeled case comprising:
a main body;
a plurality of side wheels;
a handle;
an extending wheel system;
a cup holder;
the main body comprising a plurality of attachment rails, a main compartment, a side compartment, and a plurality of connecting rails;
the handle comprising a handle hinge and a handle button;
the extending wheel system comprising an extending wheel, an extending wheel hinge, an extending wheel lock, and an extending swivel arm;
the cup holder comprising a cup holder hinge;
the plurality of side wheels being positioned along the left and right side of the bottom of the main body;
the handle being integrated along the top side of the main body;
the extending wheel system being integrated centrally along the rear side of the main body;
the cup holder being integrated on the top side of the main body;
the cup holder being positioned offset the handle;
the main body being a rectangular hollow shape; and
the main body having curved edges.

2. The mobile wheeled case as claimed in claim 1 comprising:
the plurality of attachment rails being integrated along the front side of the main body;
the plurality of attachment rails receiving an external accessory;
the plurality of attachment rails receiving a plurality of connecting rails;
the main compartment being integrated into the center of the main body;
the side compartment being integrated along the side of the main body;
the plurality of connecting rails being integrated along the front side of the main body;
the plurality of connecting rails being positioned offset the extending wheel system;
the main compartment comprising a zipper and a main compartment flap; and
the side compartment comprising a latch.

3. The mobile wheeled case as claimed in claim 2 comprising:
the main body being a polycarbonate material;
the main compartment flap being positioned centrally along the front of the main body;
the main compartment flap being a flexible material;
the main compartment flap opening to reveal the main compartment;
the zipper traversing around the main compartment flap; and
the zipper securing the main compartment flap shut when zipped closed.

4. The mobile wheeled case as claimed in claim 3 comprising:
the main compartment flap comprising a plurality of mesh pockets;
the plurality of mesh pockets being positioned along the inner side of the main compartment flap; and
the plurality of mesh pockets expanding to receive various external items.

5. The mobile wheeled case as claimed in claim 2 comprising:
the latch securing the side compartment closed to the main body;
the latch pulling outwards to unlock the side compartment; and
the latch being a locking mechanism.

6. The mobile wheeled case as claimed in claim 1 comprising:
the plurality of side wheels rotating around the plurality of side wheels central axis.

7. The mobile wheeled case as claimed in claim 1 comprising:
the handle extending out from the main body;
the handle collapsing into the main body;
the handle hinge folding the top of the handle with respect to the rest of the handle;
the handle button being integrated along the handle hinge; and
the handle button mechanically locking and unlocking the handle hinge.

8. The mobile wheeled case as claimed in claim 7 comprising:
the handle further comprising a phone case;
the phone case securing an external mobile device; and
the phone case securing to the top of the handle.

9. The mobile wheeled case as claimed in claim 1 comprising:

the extending wheel rotating on the extending wheel system;

the extending wheel contacting the ground below the present invention;

the extending wheel hinge securing the extending wheel system to the main body; and the extending wheel hinge swinging the extending wheel system outwards from the main body.

10. The mobile wheeled case as claimed in claim 9 comprising:

the extending wheel lock securing the extending wheel system into the main body;

the extending wheel lock releasing the extending wheel system from the main body; and the extending swivel arm allowing the extending wheel to rotate 360 degrees with respect to the extending wheel system axis.

11. The mobile wheeled case as claimed in claim 10 comprising:

the extending wheel lock further comprising a wheel lock button; and the extending wheel lock mechanically locking and unlocking the extending wheel system.

12. The mobile wheeled case as claimed in claim 1 comprising:

the cup holder comprising a cup holder hinge and a cup holder wall;

the cup holder securing an external cup;

the cup holder wall sliding up and down to hold the cup holder in place;

the cup holder hinge allowing the cup holder to rotate with respect to the main body; and the cup holder staying upright as the main body is tilted.

13. A mobile wheeled case comprising:

a main body;

a plurality of side wheels;

a handle;

an extending wheel system;

a cup holder;

the main body comprising a plurality of attachment rails, a main compartment, a side compartment, and a plurality of connecting rails;

the handle comprising a handle hinge and a handle button;

the extending wheel system comprising an extending wheel, an extending wheel hinge, an extending wheel lock, and an extending swivel arm;

the cup holder comprising a cup holder hinge;

the plurality of side wheels being positioned along the left and right side of the bottom of the main body;

the handle being integrated along the top side of the main body;

the extending wheel system being integrated centrally along the rear side of the main body;

the cup holder being integrated on the top side of the main body;

the cup holder being positioned offset the handle;

the main body being a rectangular hollow shape;

the main body having curved edges;

the plurality of attachment rails being integrated along the front side of the main body;

the plurality of attachment rails receiving an external accessory;

the plurality of attachment rails receiving a plurality of connecting rails;

the main compartment being integrated into the center of the main body;

the side compartment being integrated along the side of the main body;

the plurality of connecting rails being integrated along the front side of the main body;

the plurality of connecting rails being positioned offset the extending wheel system;

the main compartment comprising a zipper and a main compartment flap; and the side compartment comprising a latch.

14. The mobile wheeled case as claimed in claim 13 comprising:

the main body being a polycarbonate material;

the main compartment flap being positioned centrally along the front of the main body;

the main compartment flap being a flexible material;

the main compartment flap opening to reveal the main compartment;

the zipper traversing around the main compartment flap;

the zipper securing the main compartment flap shut when zipped closed;

the main compartment flap comprising a plurality of mesh pockets;

the plurality of mesh pockets being positioned along the inner side of the main compartment flap;

the plurality of mesh pockets expanding to receive various external items;

the latch securing the side compartment closed to the main body;

the latch pulling outwards to unlock the side compartment; and the latch being a locking mechanism.

15. The mobile wheeled case as claimed in claim 13 comprising:

the plurality of side wheels rotating around the plurality of side wheels central axis;

the handle extending out from the main body;

the handle collapsing into the main body;

the handle hinge folding the top of the handle with respect to the rest of the handle;

the handle button being integrated along the handle hinge;

the handle button mechanically locking and unlocking the handle hinge;

the handle further comprising a phone case;

the phone case securing an external mobile device; and the phone case securing to the top of the handle.

16. The mobile wheeled case as claimed in claim 13 comprising:

the extending wheel rotating on the extending wheel system;

the extending wheel contacting the ground below the present invention;

the extending wheel hinge securing the extending wheel system to the main body;

the extending wheel hinge swinging the extending wheel system outwards from the main body;

the extending wheel lock securing the extending wheel system into the main body;

the extending wheel lock releasing the extending wheel system from the main body;

the extending swivel arm allowing the extending wheel to rotate 360 degrees with respect to the extending wheel system axis;

the extending wheel lock further comprising a wheel lock button; and the extending wheel lock mechanically locking and unlocking the extending wheel system.

17. The mobile wheeled case as claimed in claim 13 comprising:

the cup holder comprising a cup holder hinge and a cup holder wall;

the cup holder securing an external cup;

the cup holder wall sliding up and down to hold the cup holder in place;

the cup holder hinge allowing the cup holder to rotate with respect to the main body; and the cup holder staying upright as the main body is tilted.

18. A mobile wheeled case comprising:

a main body;

a plurality of side wheels;

a handle;

an extending wheel system;

a cup holder;

the main body comprising a plurality of attachment rails, a main compartment, a side compartment, and a plurality of connecting rails;

the handle comprising a handle hinge and a handle button;

the extending wheel system comprising an extending wheel, an extending wheel hinge, an extending wheel lock, and an extending swivel arm;

the cup holder comprising a cup holder hinge;

the plurality of side wheels being positioned along the left and right side of the bottom of the main body;

the handle being integrated along the top side of the main body;

the extending wheel system being integrated centrally along the rear side of the main body;

the cup holder being integrated on the top side of the main body;

the cup holder being positioned offset the handle;

the main body being a rectangular hollow shape;

the main body having curved edges;

the plurality of attachment rails being integrated along the front side of the main body;

the plurality of attachment rails receiving an external accessory;

the plurality of attachment rails receiving a plurality of connecting rails;

the main compartment being integrated into the center of the main body;

the side compartment being integrated along the side of the main body;

the plurality of connecting rails being integrated along the front side of the main body;

the plurality of connecting rails being positioned offset the extending wheel system;

the main compartment comprising a zipper and a main compartment flap;

the side compartment comprising a latch;

the main body being a polycarbonate material;

the main compartment flap being positioned centrally along the front of the main body;

the main compartment flap being a flexible material;

the main compartment flap opening to reveal the main compartment;

the zipper traversing around the main compartment flap;

the zipper securing the main compartment flap shut when zipped closed;

the main compartment flap comprising a plurality of mesh pockets;

the plurality of mesh pockets being positioned along the inner side of the main compartment flap;

the plurality of mesh pockets expanding to receive various external items;

the latch securing the side compartment closed to the main body;

the latch pulling outwards to unlock the side compartment; and the latch being a locking mechanism.

19. The mobile wheeled case as claimed in claim 18 comprising:

the plurality of side wheels rotating around the plurality of side wheels central axis;

the handle extending out from the main body;

the handle collapsing into the main body;

the handle hinge folding the top of the handle with respect to the rest of the handle;

the handle button being integrated along the handle hinge;

the handle button mechanically locking and unlocking the handle hinge;

the handle further comprising a phone case;

the phone case securing an external mobile device; and the phone case securing to the top of the handle.

20. The mobile wheeled case as claimed in claim 18 comprising:

the extending wheel rotating on the extending wheel system;

the extending wheel contacting the ground below the present invention;

the extending wheel hinge securing the extending wheel system to the main body;

the extending wheel hinge swinging the extending wheel system outwards from the main body;

the extending wheel lock securing the extending wheel system into the main body;

the extending wheel lock releasing the extending wheel system from the main body;

the extending swivel arm allowing the extending wheel to rotate 360 degrees with respect to the extending wheel system axis;

the extending wheel lock further comprising a wheel lock button;

the extending wheel lock mechanically locking and unlocking the extending wheel system;

the cup holder comprising a cup holder hinge and a cup holder wall;

the cup holder securing an external cup;

the cup holder wall sliding up and down to hold the cup holder in place;

the cup holder hinge allowing the cup holder to rotate with respect to the main body; and the cup holder staying upright as the main body is tilted.

* * * * *